US006708434B1

(12) United States Patent
Zarrow et al.

(10) Patent No.: US 6,708,434 B1
(45) Date of Patent: Mar. 23, 2004

(54) REMOVABLE TAB AND METHOD FOR GAINING PHYSICAL CONTROL OF AN OBJECT

(76) Inventors: Nancy Zarrow, 87 Livingston Rd., Wellesley, MA (US) 02482; Kenneth Buckley, 30 Dawson Dr., Needham, MA (US) 02492

( * ) Notice: Subject to any disclaimer, the term of this patent is extended or adjusted under 35 U.S.C. 154(b) by 240 days.

(21) Appl. No.: 09/641,862

(22) Filed: Aug. 18, 2000

Related U.S. Application Data

(60) Provisional application No. 60/150,013, filed on Aug. 20, 1999.

(51) Int. Cl.[7] ..... G09F 3/10; B65D 33/14

(52) U.S. Cl. ..... 40/638; 40/673; 383/9; 383/84

(58) Field of Search ..... 40/638, 673; 383/11, 383/9, 84, 86; 206/736

(56) References Cited

U.S. PATENT DOCUMENTS 3,884,443 A * 5/1975 McMaster ..... 248/467
5,542,634 A * 8/1996 Pomerantz ..... 248/214
5,728,440 A * 3/1998 Good ..... 428/40.1
5,791,474 A * 8/1998 Hansen ..... 206/449
5,931,581 A * 8/1999 Garberg et al. ..... 383/9
6,382,676 B1 * 5/2002 Cochran et al. ..... 283/51

OTHER PUBLICATIONS

Versa–Clip® Butterfly Hole, p. 27, Fasteners For Retail Catalog, 1994.*

* cited by examiner

*Primary Examiner*—Cassandra H. Davis
(74) *Attorney, Agent, or Firm*—Brian M. Dingman, Esq.; Mirick, O'Connell, DeMallie & Lougee, LLP

(57) ABSTRACT

A removable tab for gaining control of an object, having a predefined weight, that generally comprises: at least one sheet of polymeric film, wherein an opening is provided through the sheet, wherein the film is of a size, thickness and tensile strength that are adapted to support the weight of the object; and an adhesive provided on at least one surface of the sheet of polymeric film having an adhesive strength adapted to enable said adhesive to adhere to and to support or carry the weight of the object and yet still enable the sheet to be peeled from the object without damaging the object; and a method for using the same.

5 Claims, 1 Drawing Sheet

REMOVABLE TAB AND METHOD FOR GAINING PHYSICAL CONTROL OF AN OBJECT

This application claims the benefit of provisional application Ser. No. 60/150,013 filed Aug. 20, 1999.

FIELD OF THE INVENTION

This invention relates to devices used to display or stock objects or to otherwise gain physical control of an object and more specifically to a tab, preferably with a hole or slot in the tab, that can be removably fixed to the object.

BACKGROUND OF THE INVENTION

There are many objects that need to be displayed or stocked or transported through a production process that are too flexible to support their own weight. Such flexible objects must be hung on hooks or stacked flat to properly display, store or transport these items. However, stacking the items is inefficient and inappropriate for display and most objects do not have a means from which to hang the object or to otherwise gain physical control of the object without damaging the object. To gain physical control of such objects, the objects must be additionally packaged and oftentimes packaged in multiples rather than individually because individual packaging would be cost prohibited. The extra packaging increases the manufacturing cost of the object, so that, if passed on to the customer, increases the retail price of the object, or if absorbed by the manufacturer, decreases the profit margin on the object. Often the types of objects that require hanging are too small or too inexpensive to justify the additional cost of packaging these items solely for display. In instances where multiple items are packaged together, customers choose not to purchase the entire package because they do not need more than one item.

With regard to flexible objects that are made from paper or plastic film, some have tried to mitigate the extra packaging costs by adding, when possible, a paper or plastic extension on the edge of the object that can be torn off, before using the object, along a perforation formed in the object. Yet, for most objects such perforated sections are not possible, and even if possible, leave an unsightly, roughened edge along the perforation.

Another problem is the necessity of printing a bar code or other non-decorative printed matter either on the object itself or on the object packaging. Neither of these two options is desirable. By its nature, non-decorative printing on any object is unsightly and, in the case of barcodes, is economically prohibited. As for printing on object packaging, this is only a reasonable alternative if the object is to be packaged for other reasons. If the object need not be packaged and yet is packaged simply to provide a surface on which a bar code or non-decorative matter can be printed, then the packaging is an extra cost that must be absorbed by the seller or buyer.

SUMMARY OF THE INVENTION

It is therefore a primary object of this invention to provide a removable tab with an opening through the tab for hanging and displaying or storing flaccid retail items that are otherwise incapable of being stood upright on a shelf or display counter.

It is a further object of this invention to provide a removable tab for gaining physical control of an object whereby the tab is removably fixed to the object and extends in part beyond the periphery.

It is a further object of this invention to provide a removable tab, that is adapted to hang an item from a display hook or to provide space for printing various sales and promotional matter, and that can be subsequently removed to maintain the aesthetic integrity of the item.

It is a further object of this invention to provide a removable tab with sufficient space on the tab for printing a barcode or other printed matter.

It is a further object of this invention to provide a removable tab for increasing, or merely providing, space on an object for printing decorative matter such as colorful trademarks, eye-catching designs and other promotional information without marring the surface of the object.

It is a further object of this invention to provide a removable tab that obviates the otherwise typical need to print a non-colored background on colored product packaging before printing a bar code on the packaging.

It is a further object of this invention to provide a removable area, for additional stickers and markings that are added at the retail level, to protect the aesthetic integrity of the object.

This invention is, in part, the result of efforts to design a cost-effective, convenient and aesthetically pleasing means for displaying an object that is incapable of being stood on a shelf or display counter because the object cannot support its own weight. It was a further goal to design such a means for gaining physical control of an object in a variety of circumstances that could be removed without damaging the object. Although the removable tab of the invention is particularly useful for flaccid objects, the tab of the invention may be readily adapted for use with virtually any type of object The preferred embodiment of the removable tab of the invention for hanging an object, having a predefined weight, from a hook, generally comprises: at least one sheet of polymeric film, wherein the film has a opening through the sheet that is adapted to receive the hook through the opening for hanging the object from the hook, and wherein the film is of a size, thickness and tensile strength that is adapted to support the weight of the object; and an adhesive provided on at least one surface of the sheet of polymeric film having an adhesive strength adapted to enable said adhesive to adhere to and to support the weight of the object and yet still enable the sheet to be peeled from the object without damaging the object. The sheet may further comprise at least one surface on which one or more identifying figures are printed, wherein such identifying figures may include, but are not limited to, barcodes, letters, numbers, words, designs, trademarks, logos and combinations thereof.

Another preferred embodiment of the removable tab of the invention for hanging an object, having a predefined weight, from a hook, comprises: at least one sheet, wherein an opening is provided through the sheet that is adapted to receive the hook through the opening for hanging the object from the hook, wherein the film is of a size, thickness and tensile strength that are adapted to support the weight of the object; and an adhesive provided on at least one surface of the sheet and having an adhesive strength adapted to enable the adhesive to adhere to and to support the weight of the object and yet still enable the sheet to be peeled from the object. The sheet may be made of any suitable material, including, but not limited to, a polymeric film and may also comprise at least one surface on which one or more identifying figures are printed.

Another preferred embodiment of the removable tab of the invention for gaining physical control of an object comprises: a removable tab comprising one or more means for gaining physical control of the object, wherein said tab is adapted to be removably fixed to the object so that at least a portion of the tab extends outward from an edge of the object, wherein the tab may further comprise one or more means for gaining physical control of the object and wherein the means for gaining control may comprise an opening through the portion of said tab that extends outward from the edge of the object.

The preferred method of the invention for displaying an object, comprises the steps of: providing an object to be displayed having a predefined weight; providing a display hook from which the object is to be hung; providing a removable tab comprising, at least one sheet of polymeric film, wherein the film has a opening through the sheet that is adapted to receive the hook through the opening; and an adhesive provided on at least one surface of the sheet of polymeric film; pressing the sheet against a surface of the object so that at least the opening of the sheet extends outwards from the object; and passing the hook at least partially through the opening so that the object hangs from the hook. Similarly, the sheet may further comprise at least one surface on which one or more identifying figures are printed.

Another preferred method of the invention for displaying an object, comprising the steps of: providing an object to be displayed having a predefined weight; providing an adhesive; providing a hook from which the object is to be hung; providing a removable tab comprising, at least one sheet, wherein an opening is provided through the sheet that is adapted to receive the hook through the opening; pressing the sheet against the object so that the adhesive is interposed between the sheet and the object and so that at least the opening of the sheet extends outwards from the object; and passing the hook at least partially through the opening so that the object hangs from the hook. The sheet may have at least one surface on which one or more identifying figures are printed.

Another preferred method of the invention for gaining physical control of an object, comprises the steps of: providing an object to be controlled having a predefined weight, at least one edge and at least one surface; providing a removable tab comprising at least one sheet and an adhesive provided on at least one surface of the sheet; providing a means for controlling said object in cooperation with the removable tab; pressing the sheet against the surface of the object so that at least the opening of the sheet extends outwards from the edge of the object; and initiating the means for controlling in cooperation with the tab so that the means for controlling gains physical control of the object, wherein the tab may further comprise an opening through the tab whereby the means for controlling controls the object in cooperation with the opening.

BRIEF DESCRIPTION OF THE DRAWINGS

Other objects, features and advantages will occur to those skilled in the art from the following description of the preferred embodiments and the accompanying drawings in which.

DESCRIPTION OF THE PREFERRED EMBODIMENTS AND METHODS

The preferred embodiment of the removable tab of the invention is generally made up of sheet of polymeric film that has a hole or slot through the sheet near an edge of the film so that the sheet, with an object attached to the sheet, can be hung from a hook or peg. The tab is attached to the object, so that the opening in the tab extends beyond the periphery of the object, by applying an adhesive of appropriate strength to a portion of the tab or to the object and then pressing the tab against the object. An adhesive of moderate strength is used so that the tab can be readily peeled off of the object after the product is purchased and before the object is used. The tab is also designed so that various information can be printed on the tab and so that printing is removed from the object when the tab is removed, rather than having to permanently print the information directly on the object or having to completely package the object to provide a printing surface for the information.

The tab of the invention is best suited for lightweight items that are thin or small with a flat surface somewhere on the item. However, the tab may be adapted to accommodate a limitless variety of objects. To do so, the size, thickness and tensile strength of the tab material must be appropriately adjusted, as well as the strength of the adhesive used.

Figure 1:
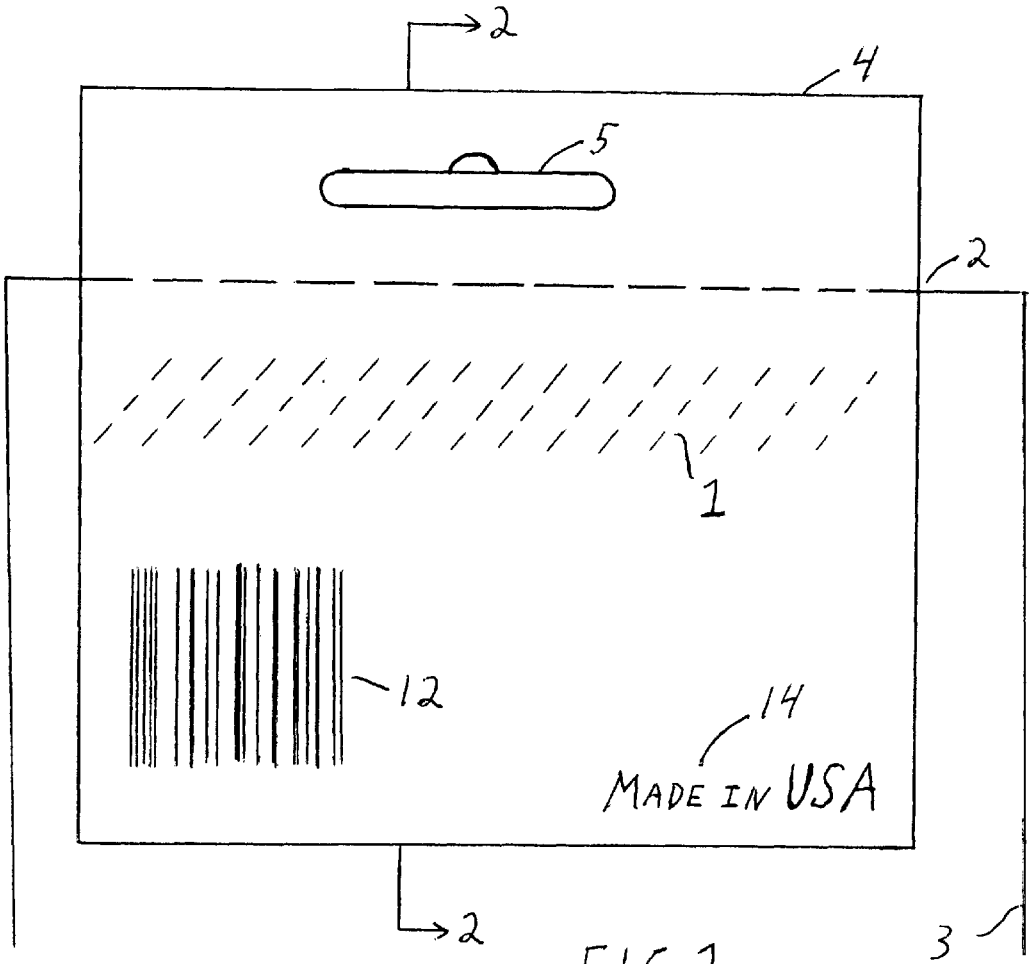
FIG. 1 is a front view of the preferred embodiment of the tab of the invention attached to a partial view of an object.
Figure 2:
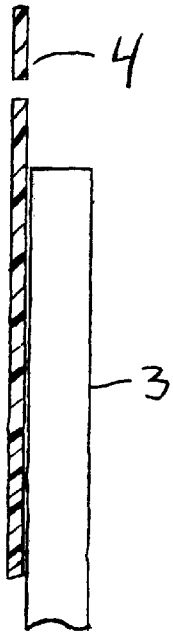
FIG. 2 is a side view of the preferred embodiment of the tab of the invention.

The tab of the invention is shown in FIG. 1 and is generally referred to as tab 10. Tab 10 is made up of sheet 4 that preferably comprises a thin film of a polymeric material, such as HDPE, although other suitable materials may be used including, but not limited to, paper, cardboard or a thin lightweight sheet of metal or wood. The material used for sheet 4 will depend on the properties of the object (3) to which the sheet is attached, the conditions in which the object will be hung and stored or displayed and the type of adhesive used. The adhesive used may be applied so that the adhesive is peeled off of the object when tab 10 is peeled off or remains for other uses such as closure.

Sheet 4 is provided with a slot 5, or another suitably sized and shaped opening, through sheet 4. There may be more than one opening in sheet 4. More than one opening may be desired or needed depending on the application. The position of slot 5 will depend on the tensile strength of sheet 4 and the weight of object 3. However, slot 5 should be relatively close to the upper edge of sheet 4 so that the upper edge of tab 10 will not extend so far above slot 5 that tab 10 take up unnecessary space. In some instances, excess room on tab 10 above slot 5 may be desired if additional space on tab 10 is needed for printing information. Slot 5 may be punched, cut or molded into sheet 4 depending on the material used for sheet 4. The size and shape of slot 5 is designed to receive a hook, peg or other such display or storage means through the opening of slot 5 so that object 3 can be suspended from the display means. The term "hook", as used herein, is not limited to a j-shaped item and includes any hook, peg, dowel, pin, hanger, spike or other such items from which objects can be hung.

Sheet 4 preferably has at least one surface on which one or more identifying figures are printed. The size of the surface will depend on the amount of printed information and other previously mentioned requirements such as tensile strength and durability. Such identifying figures or information include, but are not limited to, barcodes (e.g. barcode 12 in FIG. 1), letters, numbers, words, designs, trademarks, logos, instructions, origination statements (e.g. origination statement 14 in FIG. 1), suggested retail price and promotional matter.

Adhesive 1 is preferably applied to at least one surface of sheet 4. Adhesive 1 is preferably an adhesive that it is strong enough to adhere to, and suspend, object 3, but is resilient enough to be peeled off when tab 10 is peeled off of object 3 without damaging the object. Alternatively, adhesive 1 may be applied to object 3 rather than, or in addition to applying adhesive 1 to sheet 4, so that, when tab 10 is pressed against object 3, tab 10 will adhere to object 3. The adhesive may comprise a double-sided tape, or an adhesive applied directly to the tab or object and, depending on the application, a silicone or other suitable materials may also be applied to the tab. Also, the entire size of the tab and placement of the adhesive depends on the weight and size of the object so as to insure that the object stays in the same plane as the tab as it might have a tendency to pull away from the tab if not balanced.

As shown in FIG. 1, tab 10 extends beyond the upper edge of object 3, primarily to provide room in the tab for opening 9 and to hang the tab from a hook or peg, but also to provide extra room in the tab above the adhesive for printing additional information on the opposite side of tab 10, such as a suggested retail price (not shown) or to provide a place to receive retail pricing stickers added by the retail establishment without damaging the object or covering parts of the object.

The opening provided in the tab overcomes the problems associated with displaying and stocking an object that may be too flexible to support itself in upright conventional object displays, such as card racks that are preferred, for display purposes, over simply laying products flat on a shelf or in a box. Also, by printing the bar code, retail price, origination statement or other information on the removable tab, the object is left pristine in appearance after the tab is removed and discarded.

The tab of the invention serves several functions that can be accomplished simultaneously. The tab eliminates the need for added packaging or to bundle several objects sold as a group to justify such packaging. Thus, the tab enables a vendor to now sell items individually rather than in multiple-item packages. The tab also enables a vendor to display flaccid or limp items in an upright position, rather than stacked in a box, so that the items can be viewed immediately. The tab also reduces merchandising costs of display maintenance and reduces the need to clean up an area after consumers have moved merchandise around to look for items located under other items. The tab further functions to facilitate promotion of the items being sold and to substantially reduce the amount of space needed to display or store the items.

The tab also reduces printing costs, eliminates unsightly printing that would otherwise appear on the object, obviates the need to print a non-colored background before printing a barcode, provides more printing space than might be available on the object, provides more flexibility with printing and promotional efforts and also provides an opening for hanging an object on a display hook or peg.

The adhesive of the tab also may be adapted to provide functions in addition to the function of adhering the tab to the object. For example, if left behind on the object after the tab is removed, the adhesive can be used to provide adhesion between one part of the object and another part of the object (e.g., a flap for a bag where the bag is the object) or between the object and some other object to which the object is intended to be fixed (e.g. a card, gift or closure flap that is intended to be fixed to a gift).

The tab may also be used to provide a means for identifying, tracking, transporting and/or positioning an object during manufacturing or packaging or other processes. For example, the opening can engage with a variety of handling equipment including, but not limited to, mandrels, conveyor belts with notches, pulled by strings. Reasons for positioning the object include, but are not limited to the following: inspection, counting, vision systems, testing, carrying through various manufacturing steps, transporting to next department, bundling together through holes with wires, ties, and similar implements. The opening in the tab may also be utilized to hold a tie or other means for bundling for shipment, packaging, counting, carrying, holding. The printing on the peel off tab may also be used for registration, markings for manufacture, markings of manufacturing information needed temporarily during the process, including, but not limited to, shipment information, pricing, country of origin, instructions on use, destination information, quality control information, inspection information, work in progress information, object identification, safety certifications, importation information, OSHA requirements, warnings and sanitation information or similar markings. Printing and labeling costs are reduced by printing on the tab rather than on the object or on expensive packaging. The application will define which information is printed according to when the tab will be removed.

The preferred method of the invention for displaying an object is accomplished as described above. Generally, however, the method is accomplished by the steps of, providing the object to be displayed having a predefined weight; providing a display hook or peg from which the object is to be hung; providing the removable tab of the invention; pressing the sheet against a surface of the object so that at least the opening in the sheet extends outwards from the edge of the object; and passing the hook at least partially through the opening so that the object hangs from the hook.

Another preferred method of the invention for displaying an object may be generally accomplished by providing an object to be displayed having a predefined weight; providing an adhesive; providing a hook from which the object is to be hung; providing a removable tab comprising, at least one sheet, wherein an opening is provided through the sheet that is adapted to receive the hook through the opening, and wherein the sheet has at least one surface on which one or more identifying figures are printed; pressing the sheet against the object so that the adhesive is interposed between the sheet and the object and so that at least the opening of the sheet extends outwards from the object; and passing the hook at least partially through the opening so that the object hangs from the hook. In this method the adhesive may be applied to the tab and/or to the object before pressing all the components together.

The method of the invention is adapted to be used to gain physical control of virtually any object. A preferred method for generally gaining control of any object using the method and tab of the invention comprises the steps of: providing an object to be controlled having a predefined weight, at least one edge and at least one surface; providing a removable tab comprising at least one sheet and an adhesive provided on at least one surface of the sheet; providing a means for controlling said object in cooperation with the removable tab; pressing the sheet against the surface of the object so that at least the opening of the sheet extends outwards from the edge of the object; and initiating the means for controlling in cooperation with the tab so that the means for controlling gains physical control of the object, wherein the tab may further comprise an opening through the tab whereby the means for controlling controls the object in cooperation with the opening. For example, in a production application, an opening can be provided in the tab and the tab pressed against an object. The object can then be controlled by manually or by one or more automated means by inserting a hook or pin or other such device through the opening and pulling, dragging or otherwise transporting the object along a production line, such as a conveyor belt. If the tab is not provided with an opening, the means for controlling may comprise a clamp or clip that can be attached to the portion of the tab that extends beyond the edge of the object. Once control of the object is no longer needed, the means for controlling the object can be removed.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A container with a flap and a removable tab for hanging said container from a storage hook, wherein said container has a predefined weight, comprising:

a sheet member, wherein an opening is provided through said sheet member that is sized and shaped to receive said hook through said opening for hanging said container from said hook, wherein said sheet member is of a size, thickness and tensile strength sufficient to support said weight of said container, and comprises at least one surface on which one or more identifying figures are printed; and a pressure sensitive adhesive provided on said flap of said container, said adhesive having an adhesive strength sufficient to enable said adhesive to adhere to said sheet member, and to support said weight of said container and yet still enable said sheet member to be peeled from said adhesive on said container without damaging said container, wherein said adhesive remains on said flap after said sheet member is removed, so that said flap can then be adhered to said container, to close said container for the intended final use of said container.

2. The container with a flap and a removable tab of claim 1, wherein said identifying figures are selected from the group consisting of, barcodes, letters, numbers, designs, trademarks, logos and a combination thereof.

3. The container with a flap and a removable tab of claim 1 wherein said one or more identifying figures is selected from a group consisting of shipment information, pricing, country of origin, instructions on use, destination information, quality control information, inspection information, object identification, safety certifications, importation information, OSHA requirements, warnings and sanitation information.

4. The container with a flap and a removable tab of claim 1 wherein said sheet comprises a polymeric film.

5. A method for storing a container having a flap on a storage hook, removing the container from the storage hook, and then adhering the container flap to the container, the method comprising:

placing a pressure sensitive adhesive on said flap;

providing a sheet member, said sheet member defining an opening therethrough that is sized and shaped to receive said hook, wherein said sheet member comprises at least one surface on which one or more identifying figures are printed;

pressing said sheet member against said adhesive to adhere said sheet member to said flap such that said sheet member extends beyond said flap so that said opening in said sheet member is not blocked by said flap;

hanging said container from said hook by passing said opening of said sheet member over said hook;

removing said container from said hook by removing said sheet member and said container together from said hook;

when it is desired to close said container for the intended final use of said container, then removing said sheet member from said flap by separating said sheet member from said adhesive, whereby said adhesive remains on said flap and is exposed for use; and then adhering said flap to said container by pressing said adhesive on said flap against said container.

* * * * *